US005413517A

United States Patent [19]

Kamijima

[11] Patent Number: 5,413,517

[45] Date of Patent: May 9, 1995

[54] ACTION MECHANISM FOR DOLL

[75] Inventor: Tadashi Kamijima, Nagano, Japan

[73] Assignee: Sankyo Seiki Mfg. Co., Ltd., Nagano, Japan

[21] Appl. No.: 20,645

[22] Filed: Feb. 22, 1993

[30] Foreign Application Priority Data

Feb. 28, 1992 [JP] Japan ..... 4-009708 U
Apr. 13, 1992 [JP] Japan ..... 4-092719

[51] Int. Cl.[6] ..... A63H 3/20; A63H 3/46; A63H 31/08; F16H 37/06

[52] U.S. Cl. ..... 446/354; 446/330; 40/411; 40/420; 74/526; 74/665 M; 475/332

[58] Field of Search ..... 446/330, 331, 333, 352, 446/354, 358; 40/411, 420; 74/526, 665 L, 665 M; 475/332, 336

[56] References Cited

U.S. PATENT DOCUMENTS

| | | | |
|---|---|---|---|
| 2,584,115 | 2/1952 | Dinsmoor | 475/332 |
| 3,611,625 | 10/1971 | Sloop et al. | 446/354 |
| 4,040,206 | 8/1977 | Kimura | 446/352 |
| 4,270,622 | 6/1981 | Travis | 74/665 M |

FOREIGN PATENT DOCUMENTS

| | | | |
|---|---|---|---|
| 1017578 | 9/1952 | France | 446/352 |
| 481399 | 5/1953 | Italy | 475/332 |
| 334373 | 9/1930 | United Kingdom | 446/352 |

*Primary Examiner*—John J. Vrablik
*Attorney, Agent, or Firm*—McAulay Fisher Nissen Goldberg & Kiel

[57] ABSTRACT

A doll action mechanism which comprises a plurality of movable members for a doll or the like, a plurality of rotational drive sources arranged outside of the doll or the like, and a plurality of drive shafts individually connected to the rotational drive sources and the movable members and arranged on a common axis. Further, in another construction, a doll action mechanism has a plurality of movable members and a plurality of rotational drive sources individually coupled to the movable members. The improvement comprises a first rotational drive source for imparting an initial motion, a first movable member enabled to move by the first rotational drive source, a second movable member connected to the first movable member through a planetary gear mechanism, and a second rotational drive source for driving the second movable member.

5 Claims, 9 Drawing Sheets

ACTION MECHANISM FOR DOLL

BACKGROUND OF THE INVENTION a) Field of the Invention

The present invention relates to both an action mechanism for driving the movable members of a doll imitating a human being or an animal and a method of setting the operational initial position of the action mechanism.

b) Description of the Prior Art

Trials have been made in the prior art to move intrinsically immovable toy dolls or the like mechanically.

The dolls are called the "marionette" in Japan and the "automaton" in U.S.A. and Europe, and most of them perform predetermined motions by driving their necks or hands and feet by using springs or the like as drive sources.

These motions are divided into those imitating daily actions of a human being such as writing a letter or putting on make-up and into dancing actions to music.

The action mechanism for the aforementioned motions uses a drive source such as springs and a mechanism including cams and links to be actuated by the drive source.

Moreover, the action mechanism described above is enabled to perform a variety of dynamic actions if one or more drive motors are used and if the ON/OFF and the rotational direction of those drive motors are controlled by a computer such as a microcomputer.

When a doll or the like is to be moved by using springs as its drive source and by using a cam or link mechanism, its motion patterns are simplified. Therefore, if a plurality of actions are to be performed, it is necessary either to incorporate a complicated mechanism such as a cam or link mechanism or, as the case may be, to incorporate a partial mechanism in an exchangeable manner and to replace it.

Moreover, the action doll, i.e., the so-called "robot doll" using an actuator such as drive motors and a microcomputer for controlling the actuator is accompanied, if articulated in multiplicity or given many degrees of freedom in its movable members, by a problem in that the mechanism becomes complicated, suffers from increased weight and further, is made difficult to move easily.

Even further, when the plurality of movable members are to be controlled by computer, it becomes necessary to detect the absolute positions of the movable members in accordance with the ON/OFF of the control system. Generally speaking, position sensors are provided for the individual movable members, and drive motors are rotated in predetermined directions simultaneously as the power source of the control system is turned on so that the program is reset when the position sensors are operated.

The provision of the movable members with the position sensors makes it necessary to lead signal lines between the doll body and the control circuit disposed outside of the doll, but is adversely affected by the turning structure of the doll body. It is, therefore, conceivable to detect the rotational positions of the individual drive units by detecting the rotational positions of the drive members such as the drive shafts or drive gears which are arranged outside of the doll body for driving the individual movable members.

However, it raises a problem of increasing the number of parts and raising the production cost to provide the plurality of movable member driving members individually with the position sensors.

Still further, when the operational initial position of the actions of the doll or the like is to be set, consistency with the actions commencing subsequent to the setting operation of the initial position is lost which raises a problem that the elaborate actions are ruined if the plurality of movable member should move to their initial positions without any correlation.

OBJECT AND SUMMARY OF THE INVENTION

It is, therefore, an object of the present invention to provide a doll action mechanism which is given a variety of motions even if movable members have a small degree of freedom.

Another and second object is to provide both a doll action mechanism capable of starting its actions subsequent to the operation for setting the operational initial position and an operational initial position setting method for detecting the positions of the plurality of movable members by a single position sensor.

According to an aspect of the present invention, there is provided a doll action mechanism which comprises: a plurality of movable members for a doll or the like; a plurality of rotational drive sources arranged outside of the doll or the like; and a plurality of drive shafts individually connected to the rotational drive sources and the movable members and arranged on a common axis.

According to another feature of the present invention, there is provided a doll action mechanism which comprises: a plurality of movable members; and a plurality of rotational drive sources individually coupled to the movable members. Further comprised by the doll action mechanism are a first rotational drive source for imparting an initial motion; a first movable member enabled to move by the first rotational drive source; a second movable member connected to the first movable member through a planetary gear mechanism; and a second rotational drive source for driving the second movable member.

For a better understanding of the present inventin, reference is made to the following description and accompanying drawings while the scope of the invention will be pointed out in the appended claims.

BRIEF DESCRIPTION OF THE DRAWINGS

FIG. 3(*b*) is an enlarged left section of FIG. 3(*a*);

FIG. 7(*b*) is a perspective view showing the state of an initial position setting operation, in which one (6) of the second movable members is positioned in an initial position;

FIG. 8(*b*) is a perspective view showing the state in which only a second movable member (7) is made movable after the initial position setting;

FIG. 11(*b*) is a perspective view showing the state in which the initial position setting operations of all the second movable members (6, 7) are ended.

DESCRIPTION OF THE PREFERRED EMBODIMENTS

The present invention will be described in detail below in connection with the embodiments thereof with reference to the accompanying drawings.

Figure 1:
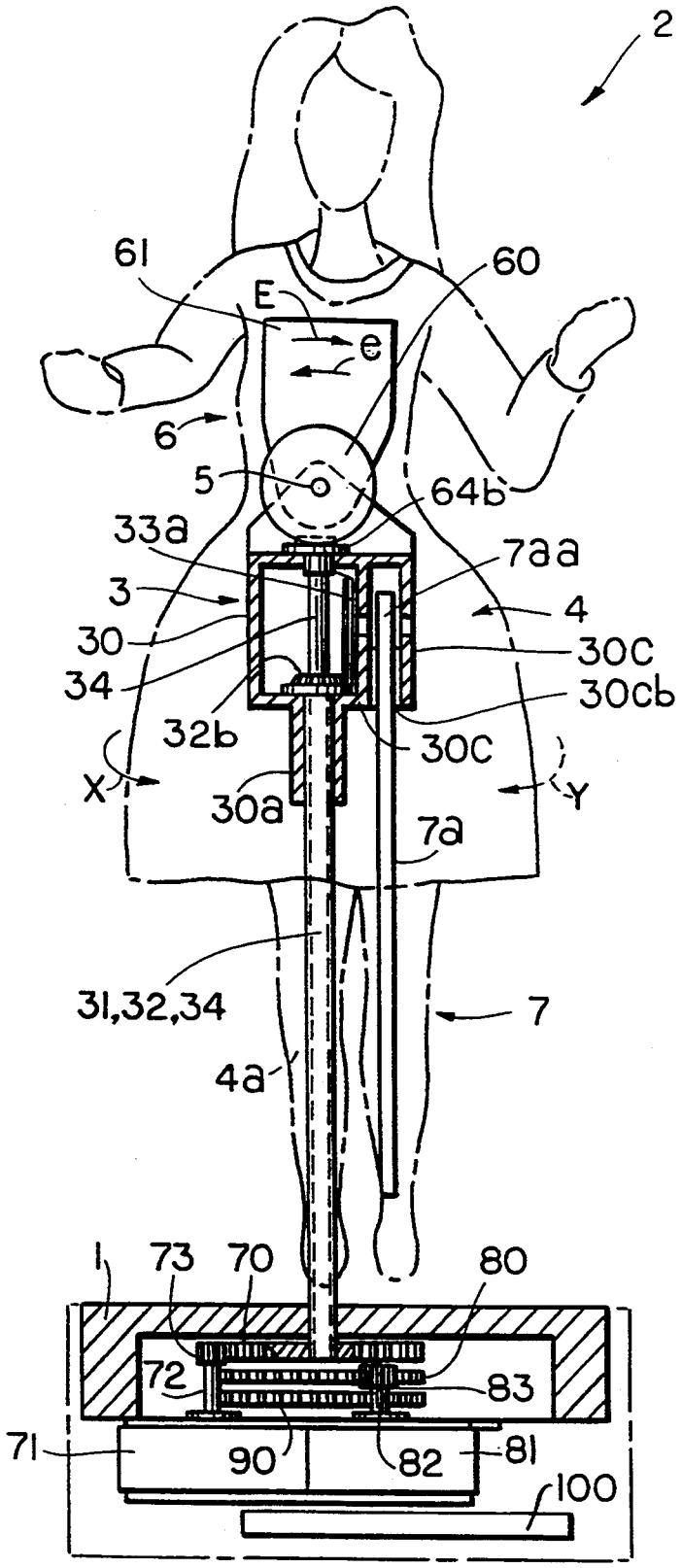
FIG. 1 is a front elevation showing an action mechanism for a doll according to one embodiment of the present invention.
Figure 2:
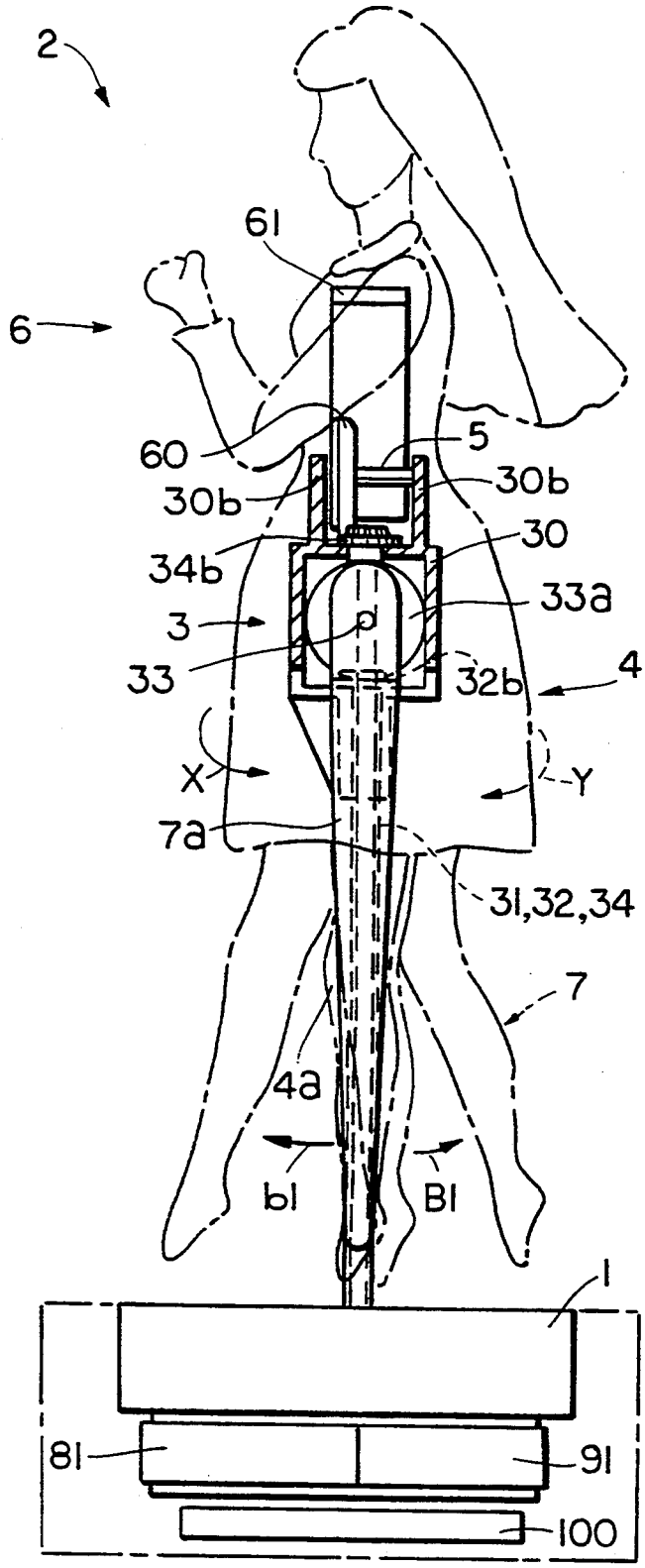
FIG. 2 is a left side view showing the same doll.

In FIGS. 1 and 2, reference numeral 1 designates a doll platform having a rotational drive source and a control circuit packaged therein, and numeral 2 designates a doll. As will be detailed hereinafter, the doll 2 is enabled to rotate (or turn) forward and backward (as indicated by arrows X and Y) in its entirety on its right leg, to have its upper half rocked (or swung) to the right and left (as indicated by arrows E and e) with a regulated movable range, and to have its left leg rocked (or kicked) back and forth (as indicated by arrows B1 and bl) on its hip joint with a regulated movable range. The doll body, as indicated by chain lines, is constructed of: a first movable member 4 (of a plurality of movable members) or its entire body including a drum having a gear box 3 packaged therein and a right leg; a second movable member 7 (of a plurality of movable members) including a left leg supported to kick by the first movable member 4; and a third movable member 6 or another second movable member supported to swing on a swing pin 5 and including an upper half composed of a breast, a head and two arms. In short, the doll 2 of the shown embodiment is constructed of one first movable member 4, the third movable member 6 as one second movable member, and the other second movable member 7. Incidentally, the two arms may be formed of a flexible material so that their shape can be freely changed between shoulders and wrists.

In FIGS. 1 to 6, the gear box 3 fixed on the first movable member 4 is constructed of: a support frame 30; a plurality of drive shafts supported fixedly or rotatably by the support frame 30; and a planetary gear mechanism composed of a combination of a plurality of bevel gears to be rotated on those drive shafts. The support frame 30 is formed at its lower end with a cylinder 30*a*, in which is fixed the upper end 31*a* of a first drive shaft 31 made of a cylinder extending through a right leg 4*a*. The lower end 31*b* of the first drive shaft 31 is extended through the doll platform 1 and is connected and fixed to a first drive gear 70.

The first drive gear 70 is meshed by a pinion 73 which is fixed on the output shaft 72 of a first drive motor 71 disposed in the lower portion of the doll platform and acting as a first rotational drive source for imparting an initial action. The rotation of the first motor 71 is decelerated and transmitted through the pinion 73 and the first drive gear 70 to the first drive shaft to rotate (or turn) the first movable member 4, i.e, the doll 2 in its entirety forward and backward on its right leg.

Into the first drive shaft 31, there is rotatably inserted a second drive shaft 32 which is cylindrically formed. On the upper end 32*a* of the second drive shaft 32, there is fixed a sun gear 32*b* which is constructed as a bevel gear. The lower end 32*c* of the second drive shaft 32 is extended from the lower end of the first drive shaft 31 and has a second drive gear 80 fixed thereon. This second drive gear 80 is meshed by a second pinion 83 which its fixed on the output shaft 82 of a second drive motor 81 acting as a second rotational drive source. The rotation of the second drive motor 81 is decelerated and transmitted to the sun gear 32b through the pinion 83 and the second drive gear 80, The sun gear 32*b* is meshed by a decelerating planetary gear 33*a* which is fixed on a shaft supported rotatably by supporting portions 30*c* and 30*c* of the support frame 30. The shaft 33 is disposed at a right angle with respect to the second drive shaft 32. On the shaft 33, there is fixed the upper end 7*aa* of a lever 7*a* inserted in the second movable member 7. In short, the planetary gear 33*a* and the lever 7*a* are integrally connected to each other.

Figure 3A:
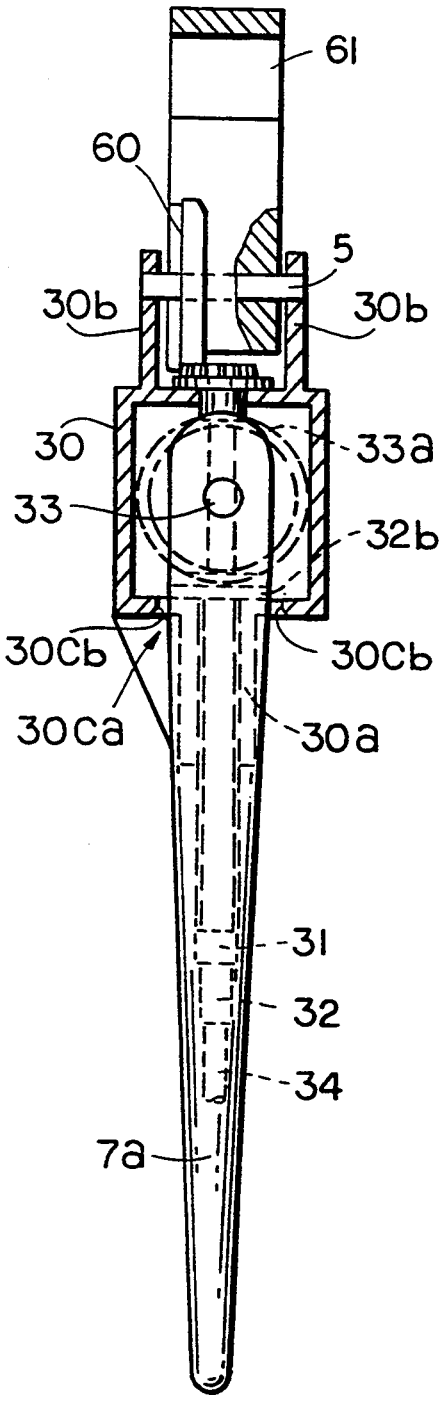
FIG. 3(*a*) is a right section showing one example of a connection mode between a drive shaft and a movable member.
Figure 3B:
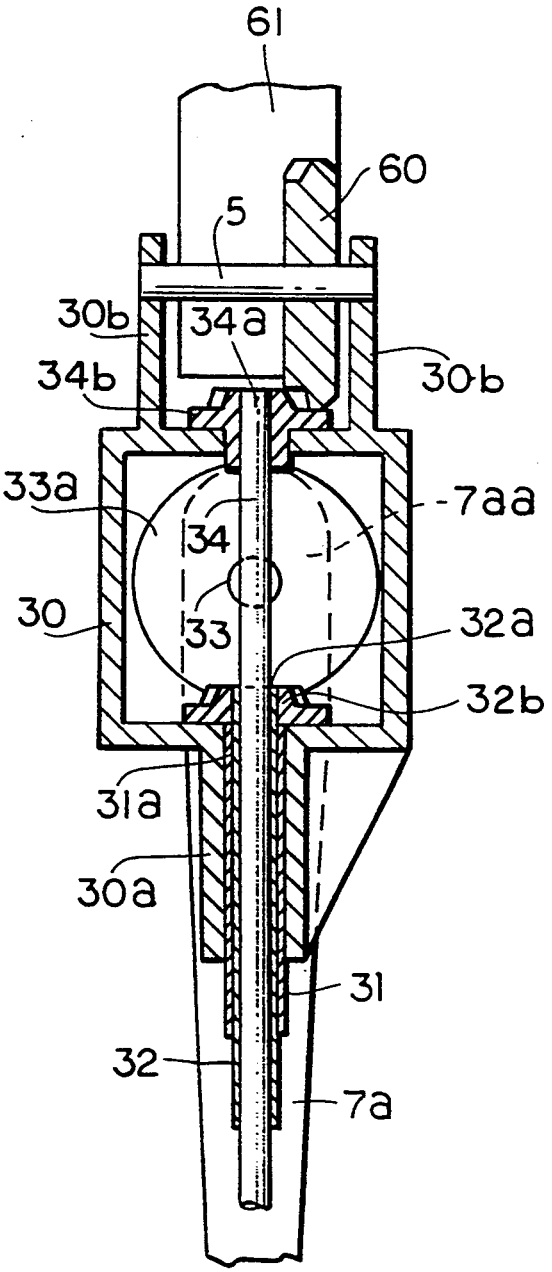

The lever 7*a* is projected downward from a lower end opening 30*ca* of the support portions 30*c* and 30*c* to have its kicking range regulated by the edges 30*cb* and 30*cb* (as better seen from FIG. 3(*a*)) of the opening 30*ca* acting as a regulating device. In short, the second movable member 7 has its kicking range regulated by the edge 30*cb*.

As will be detailed hereinafter, the lever 7*a*, i.e., the second movable member 7 is caused to either rock (or kick) back and forth at higher and lower speeds or stop in accordance with the run/stop and rotating directions of the first drive motor 71 and the second drive motor 81. In the shown example, the lever 7*a* extends to below the knee joint of the left leg 7, but may be given an elastic structure and extended to above the knee joint so that the kicking actions may look high.

Figure 4:
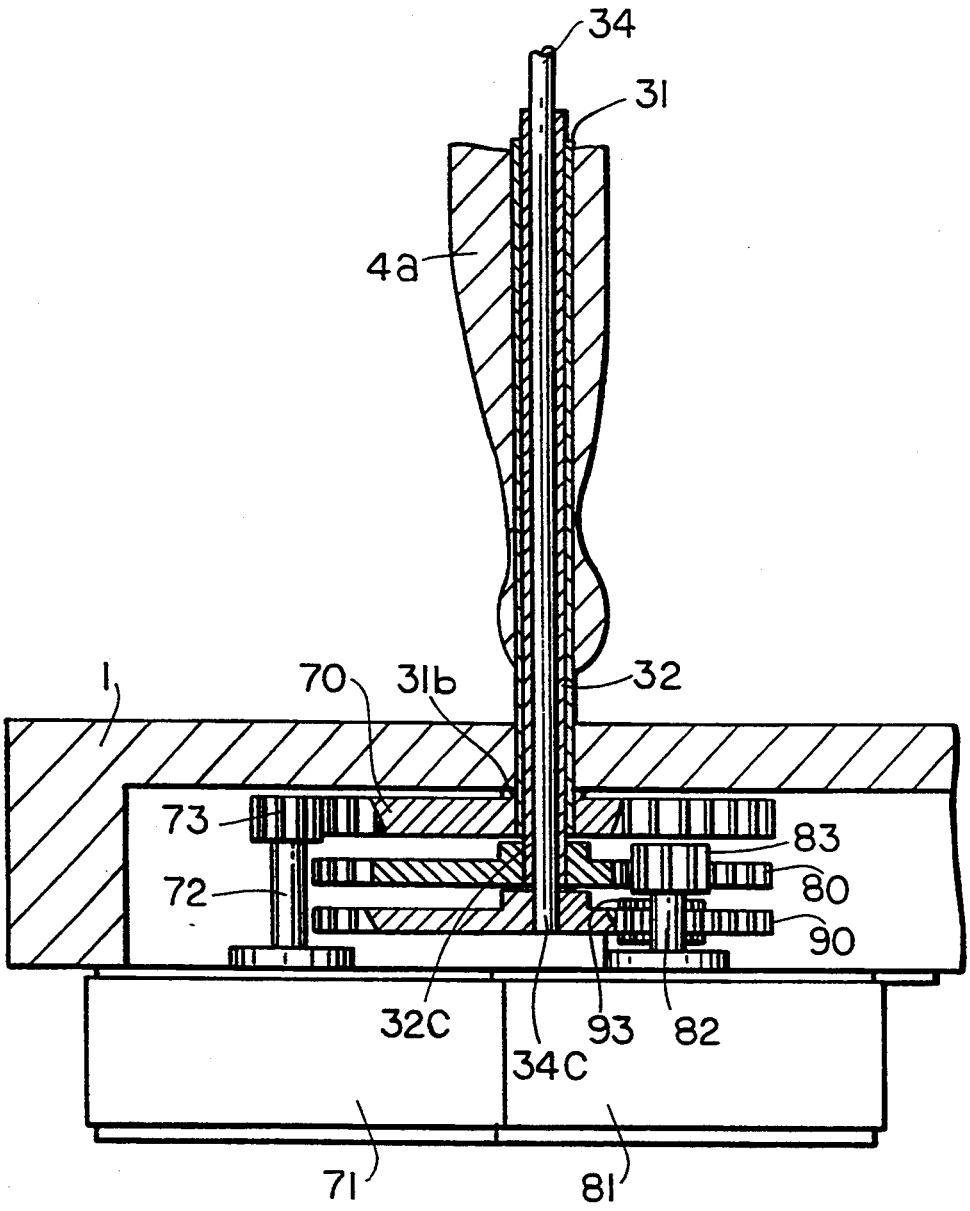
FIG. 4 is an enlarged front section showing a connection mode between the drive shaft and a rotational drive source.
Figure 5:
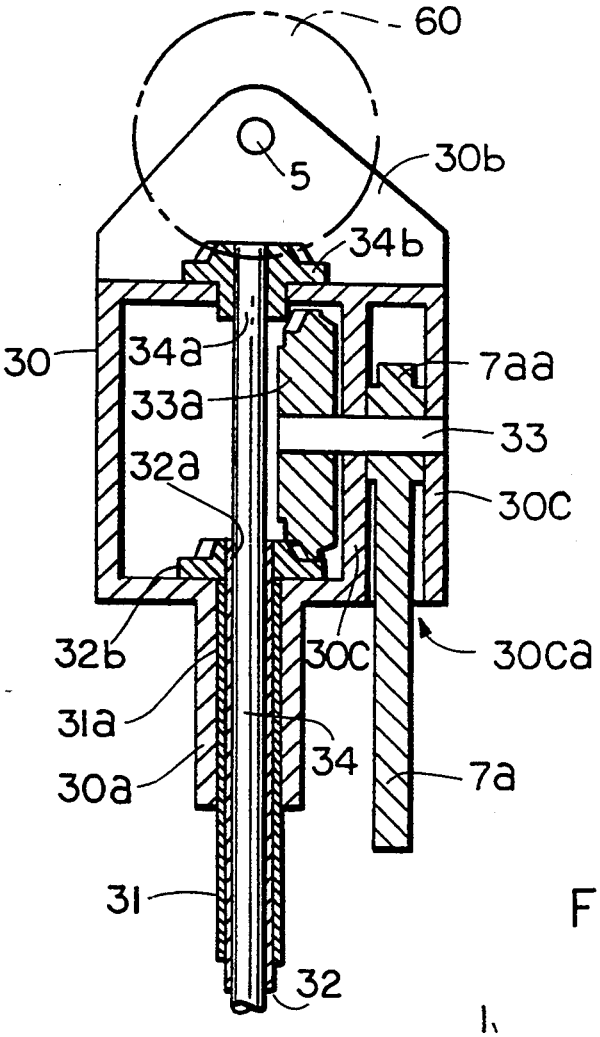
FIG. 5 is a front section showing one example of a connection mode between the drive shaft and the movable member.

Into the second drive shaft 32, there is inserted a third drive shaft 34. On the upper end 34*a* of the shaft 34, there is fixed a sun gear 34*b* made of a bevel gear. On the lower end 34*c* of the third drive shaft 34, there is fixed a third drive gear 90 which is disposed in the doll platform 1, as shown in FIG. 4. The third drive gear 90 is meshed by a third pinion 93 which is fixed on the Output shaft 92 of a third drive motor 91 acting as a second rotational drive source.

The sun gear 34*b* is meshed by a decelerating planetary gear 60 which is rotatably inserted into the swing pin 5. This swing pin 5 is borne by bearings 30*b* and 30*b* which are formed at the upper end of the support frame 30. The planetary gear 60 is fixed on a support 61 of the third movable member 6. This support 61 has its Swinging motions regulated by the not-shown regulating means which is formed in the bearing 30*b*. As a result, the third movable member 6 is regulated in its swinging movable range.

Both the edge 30*cb* for regulating the movable range of the second movable member 7 and the regulating means for regulating the movable range of the third movable member 6 are given strengths and structures capable of standing the torques which are transmitted from their individual drive motors.

As will be described hereinafter, the third movable member 6 is caused either to rock (or swing) at higher and lower different speeds or to stop in accordance with the run/stop or rotational directions of the third drive motor 91 and the first drive motor 71.

On the lower face of the ceiling of the doll platform 1, there is arranged a zero position sensor S for detecting the rotational position of the first movable member 4, i.e, the operational initial position of the doll body, as shown in FIGS. 7 to 10. The zero position sensor S may be either a contact type switch or a non-contact type switch.

The first drive motor 71, the second drive motor 81 and the third drive motor 91 are connected with a control circuit 100 (as shown in FIGS. 1 and 2) including a microcomputer so that they are controlled in their individual runs/stops and rotational directions. The zero position sensor S is also connected with the control circuit 100 to output a signal indicating the rotation of the first movable member 4 to the control circuit 100. This control circuit 100 ignores the first input signal but accepts the second signal and processes it as a program resetting signal and as a signal for setting the operational initial position thereby to start the program of the actions. Thus, the doll 2 performs the later-described various actions under the rotational controls of the individual drive motors.

The operations of the embodiment thus constructed will be described in the following.

Figure 6:
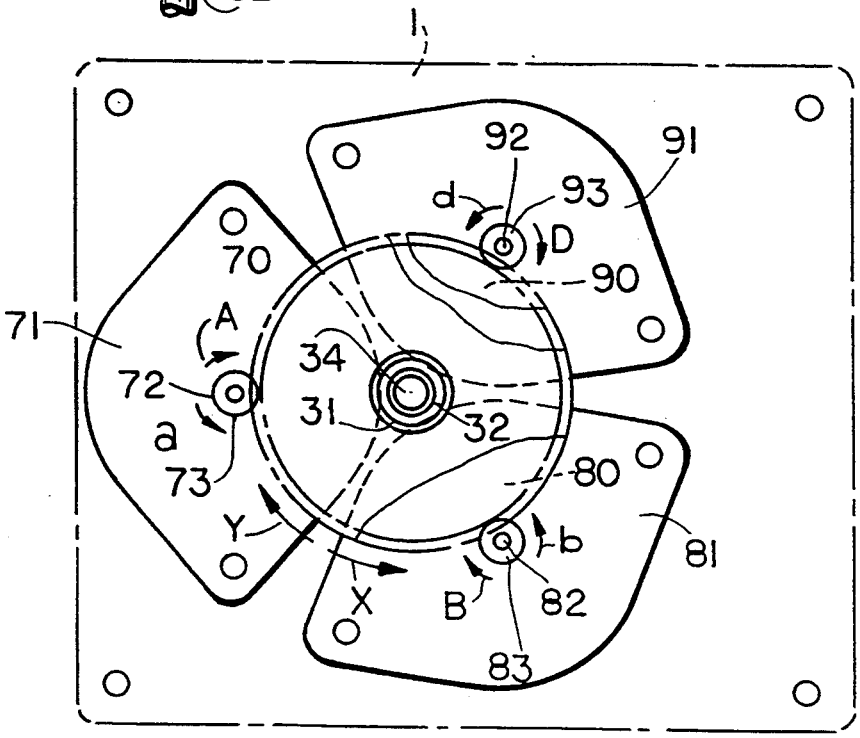
FIG. 6 is a top plan view showing relative positions of the rotational drive source and the drive shaft.

First of all, the fundamental operations of the individual movable members will be described with reference to FIGS. 1, 2 and 6. When the first drive motor 71 for imparting the initial operations rotates in the direction of arrow A, the first movable member 4, i.e., the entire body of the doll 2 is turned to the left in the direction of arrow X through the first pinion 73, the first drive gear 70 and the first drive shaft 31. If the first drive motor 71 rotates in the direction of arrow a, the doll 2 turns to the right in the direction of arrow Y.

When only the second drive motor 81 rotates in the direction of arrow B, the sun gear **32*b* is rotated through the second pinion 83, the second drive gear 80 and the second drive shaft 32 so that the left leg (7) kicks in the direction of arrow B1, as shown in FIG. 2, through the planetary gear 33*a* and the arm 7*a*. If the second drive motor 81 rotates in the direction of arrow b, the second movable member 7 or the left leg kicks forward, as indicated by arrow bl. The maximum kicking angle of the left leg in the forward and backward directions is regulated by the edges 30*cb* and 30*cb*, but the kicking strokes can also be changed according to the time duration of the power supply to the second drive motor 81**.

When only the third drive motor 91 rotates in the direction of arrow D, the sun gear **34*b* is rotated through the third pinion 93, the third drive gear 90 and the third drive shaft 34 so that the planetary gear 60 meshing therewith is rotated to swing the third movable member 6 to the right in the direction of arrow e (as shown in FIG. 1). If the third drive motor 91 rotates in the direction of arrow d, the third movable member 6 is swung to the right, as indicated by arrow E in FIG. 1. These swinging motions of the third movable member 6 are regulated by the regulating means, (not shown) but the swinging strokes of the third movable member (or the upper half of the doll body) 6 can naturally be changed by controlling the time period of the power supply to the third drive motor 91**.

On the other hand, when the first drive motor 71 rotates while the second drive motor 81 and the third drive motor 91 are left irrotational, the second movable member 7 and the third movable member 6 are individually moved relative to each other by the relations of the sun gears and the planetary gears in accordance with the turns of the doll as a whole. This planetary gear mechanism is constructed such that the several planetary gears are rotated on their individual axes and around the sun gear, which is either fixed or rotatably fitted on its center shaft, while meshing with the sun gear.

This mechanism is given the following construction in the present embodiment. Now, consider the case in FIG. 6 where the second drive motor 81 is not rotating but stopped. If, in this state, the first drive motor 71 rotates in the direction of arrow a, the first movable member 4 turns to the right in the direction of arrow Y. At this time, the second movable member 7 and the planetary gear **33*a* fixed on the former rotate together with the first movable member 4 around the sun gear 32*b* so that it will rotate the second drive shaft 32 because it is in meshing engagement with the sun gear 32*b* fixed on the second drive shaft 32. Since, however, the second drive shaft 32 is coupled through the second drive gear 80 and the second pinion 83 to the second drive motor 81, it is left reluctant to rotate by the load according to the halting torque of the second drive motor 81. As a result, the planetary gear 33*a* rotates around the sun gear 32*b* while revolving on its own axis. In other words, the second movable member 7 or the left leg is kicked back, as indicated by arrow B1. If the first drive motor 71 rotates in the direction of arrow A, the left leg (7) is kicked forward. Likewise, the third movable member 6** or the upper body half will rock (or swing) based on the principle of the relation between the sun gear and the planetary gears.

In order to turn only the first movable member 4, that is, the doll as a whole while leaving the left leg and the upper half stationary, it is sufficient to leave the second movable member 7 and the third movable member 6 irrotational relative to each other, namely, to rotate the second drive shaft 32 and the third drive shaft 34 in the same direction and at the same speed as those of the first drive shaft 31.

The motions of the doll 2 for its individual modes with reference to FIGS. 7 to 11 will now be described.

Figure 7A:
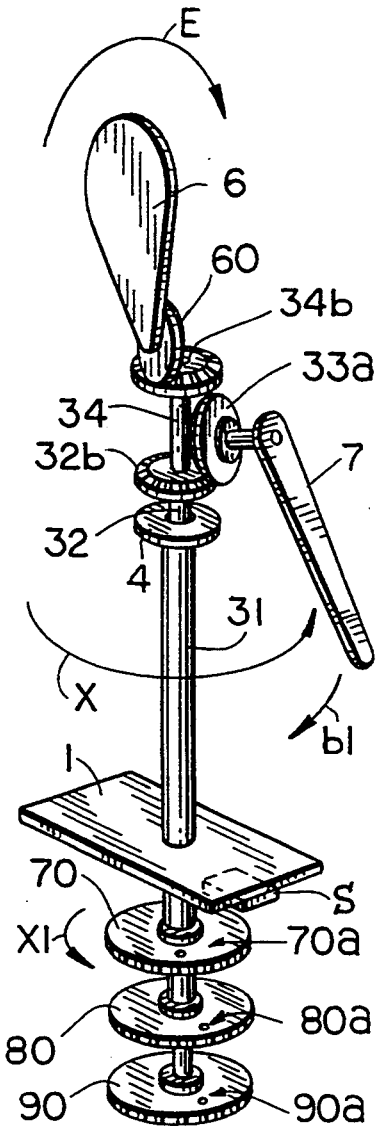
FIG. 7(*a*) is a perspective view showing the doll of FIG. 1 schematically according to one example of an operational initial state.
Figure 7B:
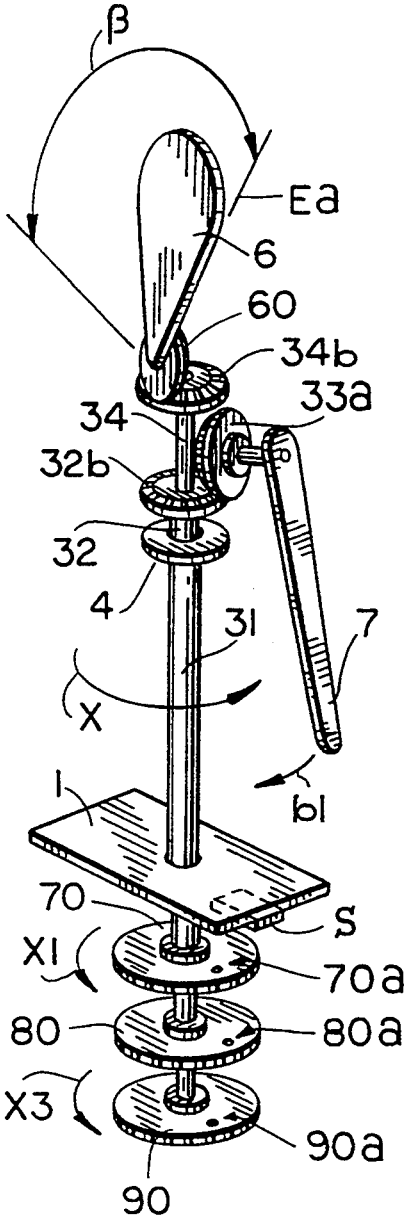

First, a method of setting the operational initial position of the action mechanism will be described. FIG. 7(*a*) shows the operational initial state (in which the preceding action is stopped) of the doll 2. In this state, the second movable member (as will be referred to the "left leg") 7 is in a back-kick position in which it is kicked back, and the third movable member (as will be referred to as the "upper half") 6 is in a rightward swung position in which it is swung slightly rightward from its neutral position. The first movable member (as will be referred to as the "entire body") 4 is directed rightward or leftward with respect to the doll platform 1 but is shown in FIGS. 7 to 11, as viewed from the righthand front of the doll 2.

Now, if the first drive motor 71 is driven to rotate the first drive gear 70 in the direction of arrow X1 of FIG. 7(*a*), the entire body 4 turns to the left in the direction X. If, at this time, the second drive motor 81 is stopped, the left leg 7 is rocked (or kicked forward) in the direction of arrow bl because the planetary gear 33*a* is rotated by the sun gear 32*b* by the principle of the planetary gear mechanism. Likewise, if the third drive motor 91 is stopped, the upper half 6 is swung to the left in the direction E because the planetary gear 60 is rotated by the sun gear 34*b*.

FIG. 7(*b*) shows the state in which the first drive gear 70 is rotated by about 20 degrees, for example in the direction X1 (as indicated by a mark 70*a* of the gear 70, as viewed from the left front). The upper half 6 is positioned at the left end Ea (i.e., the left swing end) of the movable range. If the first drive gear 70 is further rotated in the direction X1 while being held in the state shown in FIG. 7(*b*), the third drive motor 91 (as shown in FIG. 6) is rotated through the pinion 93 meshing with the third drive gear 90 by the principle of the planetary gear mechanism, thereby to turn the upper half 6 in the leftward swung state in the direction X. Incidentally, it is assumed at this time that the first drive motor 71 (as shown in FIG. 6) has sufficient torque for rotating the third drive motor 91 when stopped.

When the upper half 6 swings to the left (Ea), the left leg 7 is in the course of kicking in the direction bl so that it can be kicked more.

Figure 8A:
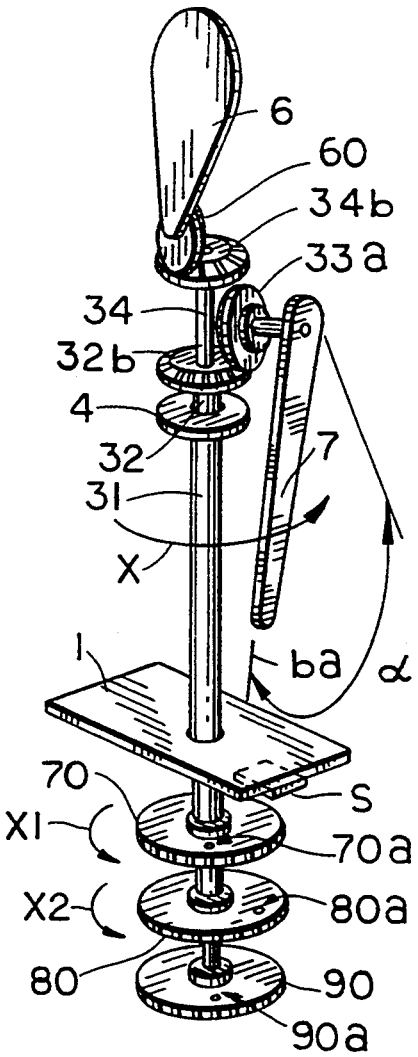
FIG. 8(*a*) is a perspective view showing the state in which the initial position setting operations of all the second movable members are ended.
Figure 8B:
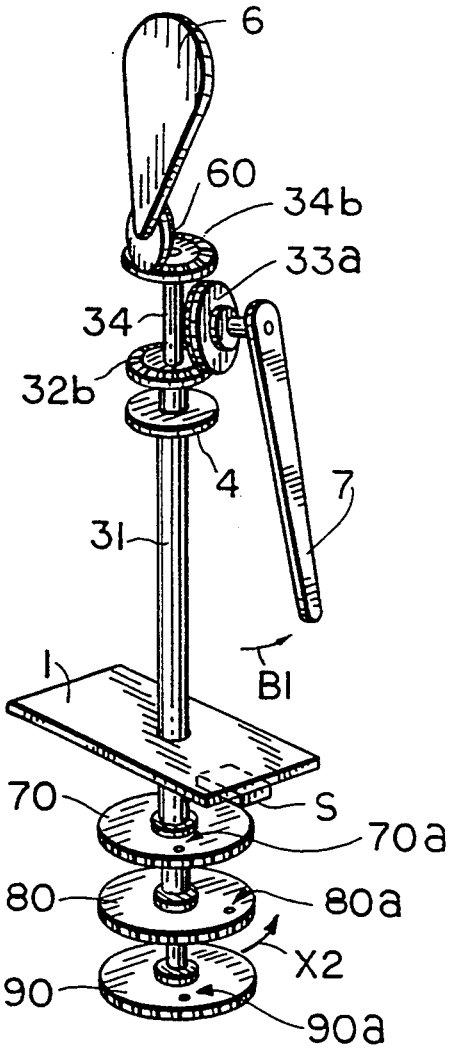

FIG. 8(*a*) shows the state, in which the first drive gear 71 further rotates in the direction X1, as viewed from the lefthand front of the doll. In this state, the first drive gear 70 and the third drive gear 90 have rotated together in the direction X1 without any relative displacement, as indicated by the marks 70*a* and 90*a*. As a result, the upper half 6 is left in the position of the end Ea (as shown in FIG. 7(*a*)) of the leftward swing. On the other hand, the left leg 7 has reached the front end ba of the forward kick and is positioned in this end of the movable range. This movable range of the left leg 7 is regulated by the front edge 30*cb* (as shown in FIG. 3(*a*)).

When the first drive motor 70 further rotates in the direction X1 with the left leg 7 is regulated in its kicking motion, that is, when the entire body 4 turns in the direction X, the second drive motor 81 is rotated through the planetary gear 33*a*, the sun gear 32*b* and the pinion 83 so that the second drive gear 80 also starts to rotate in the direction of arrow X2. As a result, when the entire body 4 turns to the left in the direction X with the upper half 6 being positioned in the end Ea of the leftward swing and with the left leg 7 being positioned in the end ba of the forward kicking motion, as shown in FIG. 8(*a*), the individual drive gears 70, 80 and 90 will rotate without any relative backlash.

If the upper half 6 and the left leg 7 are positioned in the ends of their individual movable ranges when the entire body 4 turns in the direction S, as shown in FIG. 8(*a*), they cause no new motion. When the entire body 4 is turned in the direction Y (as shown in FIGS. 1 and 2) while the second drive motor 81 and the third drive motor 91 is stopped, the upper half 6 is positioned at the end of the rightward swing, and the left leg 7 is positioned in the end of the backward kick and is turned to the right together with the entire body 4.

As described above, if the entire body 4 is sufficiently turned in the direction either to the right or left, the upper half 6 and the left leg 7 will be turned with the entire body 4 while being positioned in the righthand and lefthand ends or in the front and rear ends of their swinging and kicking ranges, no matter where they might be positioned at first. As a result, if the entire body 4 is further turned to a predetermined position with respect to the doll platform 1, then all the movable members of the doll are placed in their initial positions.

In order to detect that the initial positions of all the movable members have been located, the zero position sensor S may be used to detect the position of the first drive gear 70 which is integral with one movable member such as the first movable member 4. If only the first movable member 71 is driven to rotate the first movable member 4, the second mowable member 7 and the third movable member 6 are positioned in the ends of their individual movable ranges and placed in their initial positions. The rotational position of the first drive gear 70 may be detected by the zero position sensor S before the second and third movable members are rocked to their initial positions. For example, if the sensor operating portion of the first drive gear 70 starts its rotation from a position just in front of the zero position sensor, the rotational position of the first drive gear 70 may be detected before the second third movable members 7 and 6 come to the ends of their movable ranges. Then, there arises a phenomenon that the program starts before a complete setting of the initial position.

Thus, the control circuit 100 (as shown in FIG. 1) ignores the first position detection signal of the zero position sensor S and processes a second position detection signal, when obtained, as the signal indicating the end of setting the operational initial position. In other words, the position of another movable member is detected merely by detecting the rotational position of the first drive gear 70 so that only one zero position sensor can be sufficient for detecting the operational initial position irrespective of the number of the movable members.

At the instant when the operational initial positions of the individual movable members are set and when this setting is detected, the control circuit 100 drives the individual drive motors 71, 81 and 91 in accordance with its preset program to cause the movable members such as the upper half 6, the left leg 7 and the entire body 4 to perform their actions by moving them by the preset angles. The operational initial positions of the doll 2, i.e., the doll positions when the programmed actions are started are fixed so that the actions are started from the positions after the end of the initial position setting operations. This will be interpreted in terms of the motions of the doll. It is observed that the actions for the doll to be set to the initial position and the actions following the program are in series so that the actions prior to the action start and the subsequent actions are not unnaturally discontinuous.

Figure 9:
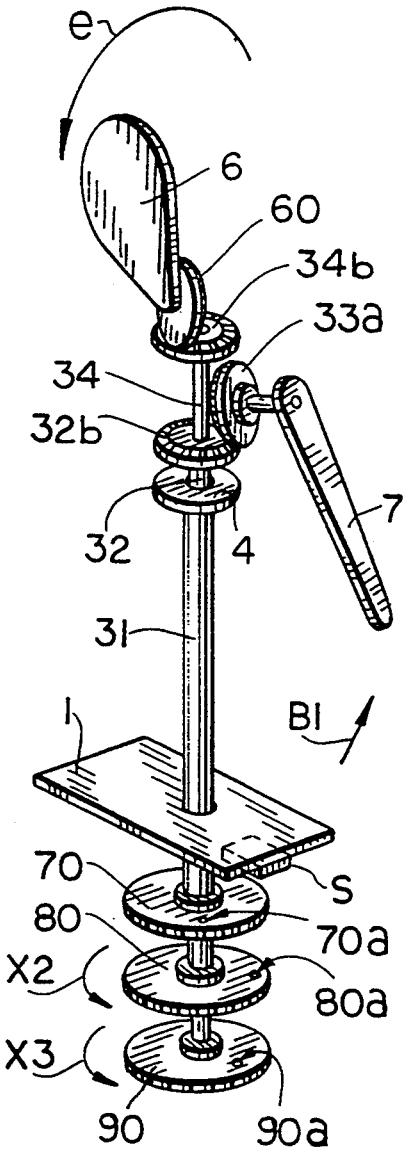
FIG. 9 is a perspective view showing the state in which the two second movable members (6, 7) are made movable.

Although the individual motions and the complex motions of the movable members will be described hereinafter, the left leg 7 is kicked backward in the direction B1 if the first drive gear 70 is stopped but the second drive gear 80 is rotated in the direction X2, as shown in FIG. 8(*b*). If the second drive gear 80 and the third drive gear 90 are simultaneously rotated in the directions X2 and X3, respectively, as shown in FIG. 9(*a*), the left leg 7 is kicked backward in the direction B1, and the upper half 6 is swung to the right in the direction e.

The embodiment thus far described makes use of the fact that the load of one gear composing the planetary gear mechanism is made larger than that of the other gear because the left leg 7 and the upper half 6 as the second movable members are positionally regulated at the ends of their movable ranges. This enables the second movable members and their supporting members (or regulating means) to have sufficient strengths. Upon setting the initial positions, moreover, there are left between the drive motor and the driven motor the bevel gear mechanism which is inefficient for the power transmission.

Therefore, described below is another embodiment having means capable of eliminating the above specified defects.

Figure 10:
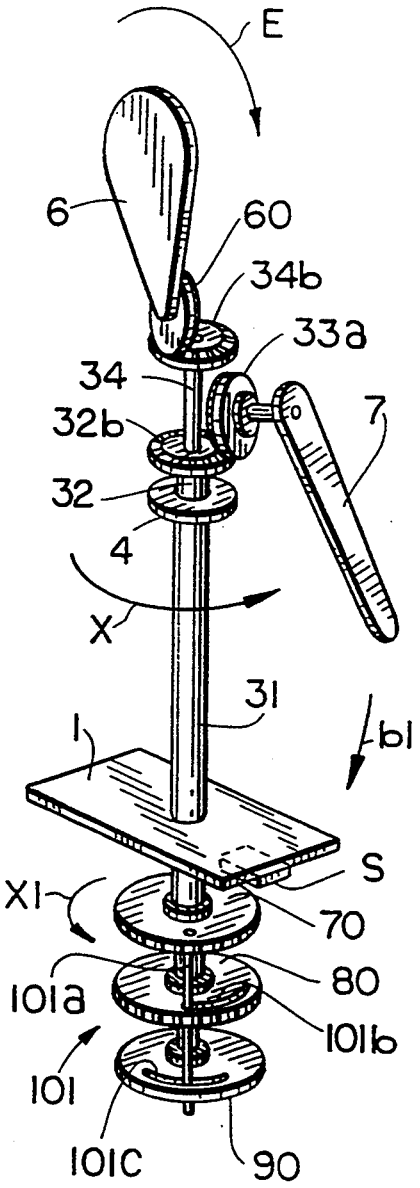
FIG. 10 is a perspective view showing an embodiment of claim 2 schematically in the initial state of the initial position setting operations.

In the first drive gear 70, as shown in FIG. 10, there is embedded downwardly a rotation regulating pin 101*a* which is loosely fitted in regulating arcuate slits 101*b* and 101*c* formed in the second drive gear 80 and the third drive gear 90. The pin 101*a* and the slits 101*b* and 101*c* have a function as the regulating means for regulating the movable range of the second movable members (7 and 6). Specifically, the slit 101*b* has its angular length set to an angle for setting the rocking range $\alpha$ a (as shown in FIG. 11(*b*)) of the left leg 7 or second movable member, and the slit 101c has its angular length set to an angle for regulating the rocking range B (as shown in FIG. 11(*a*)) of the upper half 6 or the third movable member.

If the first drive gear 70 is rotated in the direction X1 with the second drive motor 81 and the third drive motor 91 is stopped when the pin 101*a* is positioned in one end of the slit 101*b* but in a middle of the slit 101*c*, as shown in FIG. 10, the second drive gear 80 and the third drive gear 90 are forced to remain in their positions by the loads of the second drive motor 81 and the third drive motor 91 which are meshing with the second and third drive gears 80 and 90 through their pinions 83 and 93. Thus, the upper half 6 and the left leg 7 continue their rocking motions until their movable ranges are regulated by the principle of the planetary gear mechanism from the positional relations between the pin 101*a* and the slits 101*b* and 101*c*. In other words, the left leg 7 kicks in the direction bl whereas the upper half 6 swings to the left in the direction E, as shown in FIG. 10.

Figure 11A:
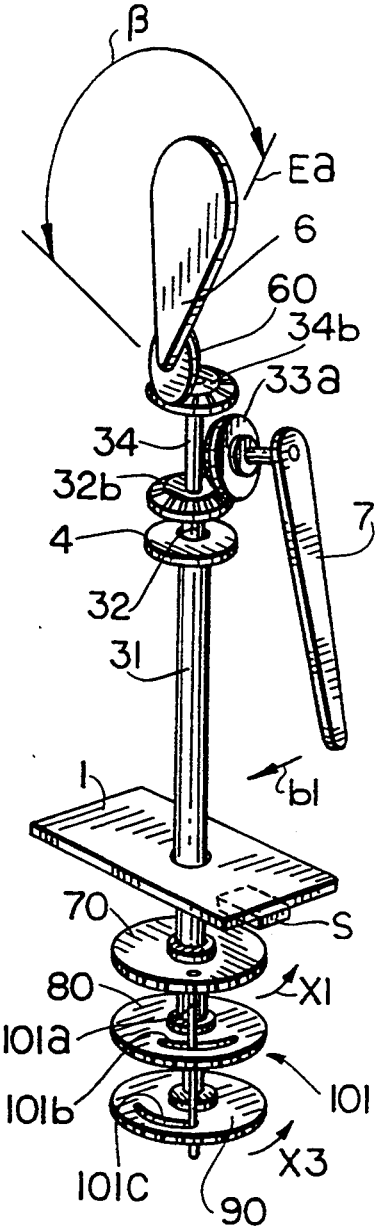
FIG. 11(*a*) is a perspective view showing the state in which one second movable member (6) is set in the initial position.
Figure 11B:
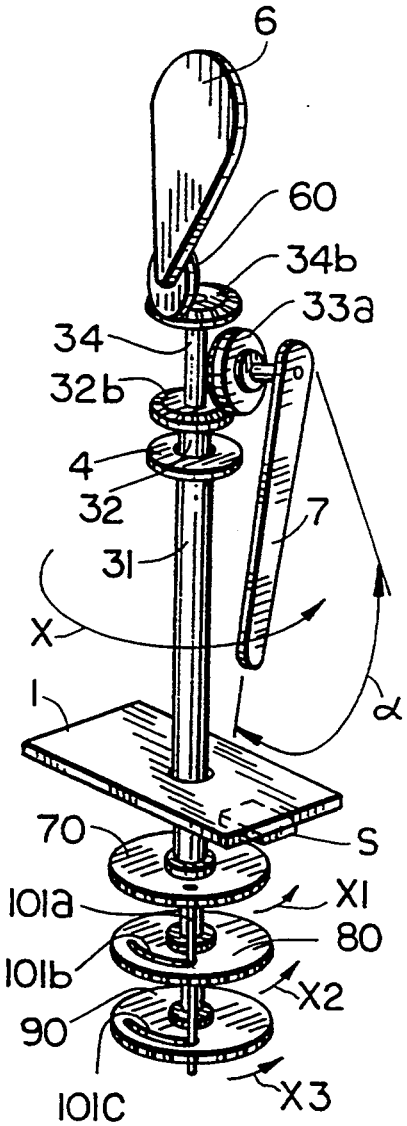

When the pin 101*a* reaches the end of the slit 101*c*, as shown in FIG. 11(*a*), the first drive gear 70 starts to rotate the third drive gear 90 directly. As a result, the upper half 6 has its independent rocking motions regulated and is positioned in the operational initial position or the end Ea of the leftward swinging motion.

When the first drive gear 70 to rotate the third drive gear 90 further rotates in the direction X1 so that the pin 101*a* reaches the end of the slit 101*b*, as shown in FIG. 11(*b*), the left leg 7 cannot rock any more independently but is rotated in the direction X2 in accordance with the rotation of the first drive gear 70. As a result, the left leg 7 is regulated to the operational initial position of the movable range end ba. At this instant, the second drive gear 80 and the third drive gear 90 rotate with the first drive gear 70, and the left leg 7 and the upper half 6 are positioned at the ends of their individual movable ranges. In other words, the first movable member 4, the second movable member 7 and the third movable member 6 rotate in the direction X while keeping their relative positional relations unchanged.

When the operational initial position is to be set, the rotational position signal of the first movable member 4 is detected by the zero position sensor S. The first signal is ignored, but the initial positions of the second movable member 7 and the third movable member 6 have been set when the second positional detection signal is detected. In response to the second signal, the control circuit 100 starts the program. The start of the program of the actions by the first movable member 4 may be selected in terms of a suitable rotational position indicating the instant when the doll faces the front or back.

In the embodiment shown in FIGS. 10 and 11, the left leg 7 or the upper half 6 is enabled to act as if they had structures for regulating their motions, by regulating the rotational ranges of the gears for driving the second and third movable members 7 and 6, despite of the failure to have means (which should be referred to the edge 30*cb* of FIG. 3(*a*)) for regulating the movable ranges of the second and third movable members directly.

Next, the motions of the doll 2 will be described for its individual modes with reference to FIGS. 1, 2 and 6. In the following description: the "entire body" indicates the entirety of the doll 2; the "left leg" indicates the left movable member 7; and the "upper half" indicates the third movable member 6.

A. Entire Body: Right Turns; and Left Leg: Stop

The first drive motor 71 is rotated in the direction of arrow a to turn the first movable member 4 to the right in the direction of arrow Y, and the second drive motor 81 is rotated in the direction of arrow b while leaving the second movable member 7 unkicked by preventing the sun gear 32*b* and the planetary gear 33*a* from rotating relative to each other. Only the first movable member 4 turns to the right in the direction of arrow Y, whereas the left leg is left stopped. These motions appear as the actions of the doll such that the entire body is turned to the right with its left leg being stopped in a closed or open position.

B. Entire Body: Right Turn; and Left Leg: Double—Speed Backward Kick

The first drive motor 71 is rotated in the direction of arrow a to turn the first movable member 4 to the right in the direction of arrow Y, and the second drive motor 81 is rotated in the direction of arrow B. Then, the planetary gear 33*a* rotates while revolving in the counter direction around the sun gear 32*b* so that the rotational speed of the planetary gear 33*a* is doubled to kick the second movable member 7 at the double speed in the direction of arrow B1. The doll 2 acts to kick back the left leg quickly while turning the entire body to the right.

C. Entire Body: Right Turn; and Left Leg: Backward Kick

The first drive motor 71 is rotated in the direction of arrow a to turn the first movable member 4 to the right in the direction of arrow Y, but the second drive motor 81 is stopped. The second movable member 7 is kicked back in the direction of arrow B1 while moving along a planetary orbit around the sun gear 32*b*. The doll 2 acts to kick back the left leg while turning the entire body to the right.

D. Entire Body: Left Turn; and Left Leg: Double—Speed Forward Kick

The first drive motor 71 is rotated in the direction of arrow A to turn the first movable member 4 to the left in the direction of arrow X, and the second drive motor 81 is rotated in the direction of arrow b to kick the second movable member 7 at the double speed in the direction of arrow bl. The doll 2 acts to kick the left leg forward while turning the, entire body to the left.

E. Entire Body: Entire Body: Left Turn; and Left

The first drive motor 71 is rotated in the direction of arrow A to turn the first movable member 4 to the left in the direction of arrow X, and the second drive motor 81 is rotated in the direction of arrow B. Since the planetary gear 33*a* revolves around the sun gear 32*b* while rotating on its axis, the second movable member 7 is left in a stopped position irrespective of the open position of the left leg. The doll 2 acts to turn the entire body to the left with the left leg being stopped.

F. Entire Body: Left Turn; and Left Leg: Forward Kick

The first drive motor 71 is rotated in the direction of arrow A to turn the first movable member 4 to the left in the direction of arrow X, but the second drive motor 81 is stopped. The second movable member 7 is kicked in the direction of arrow bl because the planetary gear 33*a* moves along a planetary orbit around the sun gear 32*b*. The doll 2 acts to kick the left leg forward while turning the entire body to the left.

G. Entire Body: Stop; and Left Leg: Forward Kick

The first drive motor 71 is stopped to stop the turn of the first movable member 4, but the second drive motor 81 is rotated in the direction of arrow b to kick the second movable member 7 in the direction of arrow bl. The doll 2 acts to kick the left leg forward without any turn.

H. Entire Body: Stop; and Left Leg: Backward Kick

The first drive motor 71 is stopped to stop the turn of the first movable member 4, but the second drive motor 81 is rotated in the direction of arrow B to kick the second movable member 7 in the direction of arrow B1. The toll 2 acts to kick the left leg backward without any turn.

I. Entire Body: Stop; and Left Leg Stop

The first drive motor 71 and the second drive motor 81 are stopped to stop the first movable member 4 and the second movable member 7 thereby to stop both the turning and kicking motions. The doll 2 is left with neither turn nor kick.

J. Entire Body: Right Turn; and Upper Half: Stop

The drive motor 71 is rotated in the direction of arrow a to turn the first movable member 4 to the right in the direction of arrow Y, and the third drive motor 9 is rotated in the direction of arrow d to stop the third movable member 6. Specifically, the planetary gear 60 rotates on its axis while revolving around the sun gear 34*b* so that the third movable member 6 neither moves relative to the sun gear 34*b* nor swings. The doll 2 acts to turn the entire body to the right with the upper half being stopped.

K. Entire Body: Right Turn; and Upper Half: Double—Speed Right Swing

The first drive motor 71 is rotated in the direction of arrow a to turn the first movable member 4 to the right in the direction of arrow Y, and the third drive motor 91 is rotated in the direction of arrow D to swing the third movable member 6 at a double speed to the right in the direction of arrow e. Since the rotation of the sun gear 34*b* and the revolution of the planetary gear 60 are in the counter directions, the planetary gear 60 rotates at a double speed to swing the third movable member 6 quickly to the right. The doll 2 acts to swing the upper half at a high speed to the right while turning the entire body to the right.

L. Entire Body: Right Turn; and Upper Half: Right

The first drive motor 71 is rotated in the direction of the first movable member 4 to the right in the direction of arrow Y, but the third drive motor 91 is stopped to rotate the planetary gear 60 while revolving it around the sun gear 34*b*, thereby to swing the third movable member 6 to the right in the direction of arrow e. The doll 2 acts to swing the upper half to the right while turning the entire body to the right.

M. Entire Body: Left Turn; and Upper Half: Double—Speed Left Swing

The first drive motor 71 is rotated in the direction of arrow A to turn the first movable member 4 to the left in the direction of arrow X, and the third drive motor 91 is rotated in the direction of arrow d to swing the third movable member 6 at a double speed to the left in the direction of arrow E. Since the rotation of the sun gear 34*b* and the revolution of the planetary gear 60 are in the counter directions, the planetary gear 60 rotates at a double speed to swing the third movable member 6 quickly to the left. The doll 2 acts to swing the upper half quickly to the left while turning the entire body to the left.

N. Entire Body: Left Turn; and Upper Half: Stop

The first drive motor 71 is rotated in the direction of arrow A to turn the first movable member 4 to the left in the direction of arrow X, and the third drive motor is rotated in the direction of arrow D to revolve and stop the third movable member 6 relatively. The doll 2 acts to turn the entire body to the left with the upper half being stopped.

O. Entire Body: Left Turn; and Upper Half: Left Swing

The first drive motor 71 is rotated in the direction of arrow A to turn the first movable member 4 to the left in the direction of arrow X, but the third drive motor 91 is stopped to swing the third movable member 6 to the left in the direction of arrow E. The doll 2 acts to swing the upper half to the left while turning the entire body to the left.

P. Entire Body: Stop; and Upper Half: Left Swing

The first drive motor 71 is stopped to stop the first movable member 4, but the third drive motor 91 is rotated in the direction of arrow d to swing the third movable member 6 to the left in the direction of arrow E. The doll 2 acts to swing the upper half to the left without any turn.

Q. Entire Body: Stop: and upper Half: Right Swing

The first drive motor 71 is stopped to stop the first movable member 4, but the third drive motor 91 is rotated in the direction of arrow D to swing the third movable member 6 to the right in the direction of arrow e. The doll 2 acts to swing the upper half to the right without any turn.

R. Entire Body: Stop; and Upper Half: Stop

Both the first drive motor 71 and the third drive motor 91 are stopped to stop both the first movable member 4 and the third movable member 6. The doll 2 is left in a stationary position.

The actions of the doll 2 thus far described are effected by the combination of ON and OFF of the first drive motor 71 and the second drive motor 81, and the first drive motor 71 and the third drive motor 91, to cause the combination of the turn and stop of the entire body, the forward/backward kicks and stop of the, left, leg, and the swing and stop of the upper half. Thus, the doll can be observed as if it were dancing, by combining those ON/OFF operations of three drive motors and by executing the combinations in a series of operations.

Moreover, the doll can be made to dance differently if there are prepared programs having changed orders of operations of the plurality of movable members.

In the shown embodiments, the zero position (i.e., the operational initial position) is detected in terms of the rotational position of the first drive gear 70 integrated with the first movable member, but could be detected in terms of the rotational position of the drive gear which is substantially integral with another movable member.

In the shown embodiments, moreover, the doll is presented to have its movable members actuated but can naturally be exemplified by a stuffed animal toy.

Since the plurality of drive shafts are arranged on the common axis, according to the present invention, the connection structure for the pluralities of drive source and movable members disposed outside of the doll or the like can be simplified to give the doll a variety of dynamic actions. Moreover, when the first One of the plurality of mowable members is driven, the second one is connected according to the planetary gear mechanism so that the second movable member can be relatively moved to cause the doll to perform the various actions by actuating the first rotational drive source for driving the first movable member.

Further still, when the first one of the plurality of movable members is driven the second one is set to the operational initial position in accordance with the planetary gear mechanism, the actions can be executed in series subsequent to that operation of setting the initial position to eliminate the feeling of disorder in the setting of the initial position prior to the start of the actions.

On the other hand, if the first movable member is driven by the first rotational drive source, the second movable member is positioned at the end of the movable range and is set in the operational initial position so that the initial position setting can be detected merely by detecting the position of any of the movable members.

This means that it is sufficient to provide only one zero position sensor, so that the number of parts and the cost can be reduced.

While the foregoing description and drawings represent the preferred embodiments of the present invention, it will be obvious to those skilled in the art that various changes and modifications may be made therein without departing from the true spirit and scope of the present invention.

What is claimed is:

1. In a doll action mechanism comprising:

a first rotational drive source for imparting an initial motion;

a first movable member enabled to move by said first rotational drive source;

a first rotational shaft for connecting said first rotational drive source with said first movable member;

a planetary gear mechanism having a sun gear disposed on a rotational axis of said first movable member and a planetary gear rotating around the sun gear with said first movable member;

a second movable member connected with said planetary gear mechanism;

a second rotational drive source for rotating said sun gear;

a second rotational shaft for connecting said second rotational drive source with said sun gear;

said second rotational shaft being disposed coaxially with said first rotational shaft; and control means for controlling said first rotational drive source and said second rotational drive source independently.

2. The doll action mechanism according to claim 1, further comprising regulating means for regulating the movable range of said second movable member.

3. The doll action mechanism according to claim 2, wherein said regulating means is interposed between the drive shaft of said first movable member and the drive shaft of said second movable member.

4. A doll action mechanism according to claim 1, wherein said second movable member is revolved along a planetary orbit to the end of the movable range thereof by causing said first rotational drive source to rotate said first movable member while interrupting the second movable member driving action of said second rotational drive source, so that the end position is set as the operational initial position of said action mechanism.

5. The doll action mechanism according to claim 4, further comprising a position sensor for detecting the operational initial position of said action mechanism.

* * * * *